US008488985B2

(12) United States Patent
Miura

(10) Patent No.: US 8,488,985 B2
(45) Date of Patent: Jul. 16, 2013

(54) IMAGE FORMING APPARATUS AND METHOD FOR APPLYING TRANSFER VOLTAGE IN THE IMAGE FORMING APPARATUS

(75) Inventor: Hiroshi Miura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 577 days.

(21) Appl. No.: 12/458,078

(22) Filed: Jun. 30, 2009

(65) Prior Publication Data

US 2010/0028033 A1 Feb. 4, 2010

(30) Foreign Application Priority Data

Jul. 31, 2008 (JP) ..... 2008-197401

(51) Int. Cl.
*G03G 15/16* (2006.01)

(52) U.S. Cl.
USPC ..... 399/66

(58) Field of Classification Search
USPC ..... 399/43, 44, 66
See application file for complete search history.

(56) References Cited

U.S. PATENT DOCUMENTS

2004/0179858 A1* 9/2004 Katoh ..... 399/50
2008/0124101 A1* 5/2008 Takahashi ..... 399/44

FOREIGN PATENT DOCUMENTS

JP 10-301344 11/1998
JP 2003-323008 A 11/2003
JP 2006-258868 A 9/2006
JP 2006-301420 A 11/2006

* cited by examiner

*Primary Examiner* — Walter L Lindsay, Jr.
*Assistant Examiner* — Barnabas Fekete
(74) *Attorney, Agent, or Firm* — Rabin & Berdo, P.C.

(57) ABSTRACT

An image forming apparatus is configured such that a developer image is transferred by a transfer section from an image bearing body onto a recording medium. The image forming apparatus includes a memory, an apparatus usage information obtaining section, and a transfer voltage correcting section. The memory stores correction values for a transfer voltage, the correction values corresponding to changes in an operation status of the image forming apparatus. The apparatus usage information obtaining section obtains information on the operation status. The transfer voltage correcting section corrects the transfer voltage based on the correction values and the information on the operation status.

22 Claims, 18 Drawing Sheets

52 : Qoff TABLE

| T0 = Tf−Te | TIME ELAPSED SINCE LAST PRINTING : Poff | Qoff |
|---|---|---|
| T0 ≧ 100(℃) | 0(H) < Poff ≦ 1(H) | −1 |
| 50(℃) < T0 < 100 (℃) | 1(H) < Poff ≦ 2(H) | −2 |
| 20(℃) < T0 < 50(℃) | 2(H) < Poff ≦ 3(H) | −3 |
| T0 < 20(℃) | 3(H) < Poff | −4 |

52 : Qoff TABLE

| T0 = Tf−Te | TIME ELAPSED SINCE LAST PRINTING : Poff | Qoff |
|---|---|---|
| T0 ≧ 100(℃) | 0(H) < Poff ≦ 1(H) | −1 |
| 50(℃) < T0 < 100 (℃) | 1(H) < Poff ≦ 2(H) | −2 |
| 20(℃) < T0 < 50(℃) | 2(H) < Poff ≦ 3(H) | −3 |
| T0 < 20(℃) | 3(H) < Poff | −4 |

53 : Vq TABLE

| REMAINING AMOUNT OF TONER Tn | PRINT DUTY D1 | 25℃ < Te<br>60% < He | 15℃ < Te ≦ 25℃<br>30% < He ≦ 60% | Te ≦ 15℃<br>He ≦ 30% |
|---|---|---|---|---|
| Tn > 20% | D1 ≧ 3000 | 0 | 0 | 0 |
| | 1500 ≦ D1 < 3000 | −50 | 0 | 0 |
| | 0 < D1 ≦ 1500 | −100 | −50 | 0 |
| | D1 = 0 | −50 | −25 | 0 |
| Tn ≦ 20% | D1 ≧ 3000 | −50 | 0 | 0 |
| | 1500 ≦ D1 <3000 | −150 | −100 | 0 |
| | 0 < D1 ≦ 1500 | −200 | −150 | 0 |
| | D1 = 0 | −100 | −75 | 0 |

54 : Vtr1 TABLE

| RECORDING MEDIUM | 25℃ < Te<br>60% < He | 15℃ < Te ≦ 25℃<br>30% < He ≦ 60% | Te ≦ 15℃<br>He ≦ 30% |
|---|---|---|---|
| ORDINARY PAPER | 3000V | 3500V | 4000V |
| THICK PAPER | 3500V | 4000V | 4500V |

FIG.18

| TIME ELAPSED SINCE POWER-ON (Hour) | 0 | 1 | 2 | 3 | 4 | 5 | 6 | 7 | 8 |
|---|---|---|---|---|---|---|---|---|---|
| CONVENTIONAL APPARATUS | ○ | △ | × | △ | △ | × | × | × | × |
| FIRST EMBODIMENT | ○ | ○ | ○ | ○ | ○ | ○ | ○ | ○ | ○ |

○ : GOOD
△ : SOMEWHAT POOR
× : UNACCEPTABLE

FIG.19

| TIME ELAPSED SINCE POWER-ON (Hour) | 0-1 | 1-2 | 2-3 | 3-4 | 4-5 | 5-6 | 6-7 | 7-8 |
|---|---|---|---|---|---|---|---|---|
| PRINT DUTY | LOW | LOW | — | — | MEDIUM | MEDIUM | LOW | MEDIUM |
| NUMBER OF PRINTED PAGES | 1000 | 1000 | — | — | 1000 | 1000 | 300 | 300 |
| REMAINING AMOUNT OF TONER (%) | 30→28 | 28→26 | 26→26 | 26→26 | 26→20 | 20→14 | 14→13 | 13→11 |
| REMARK | — | — | LEFT IDLE | POWER-OFF | — | — | — | — |

FIG.25
58 : Vtn TABLE
| Stn | Vth |
|---|---|
| Stn ≦ 1000 | −400 |
| 1000 < Stn ≦ 2000 | −300 |
| 2000 < Stn ≦ 3000 | −200 |
| 3000 < Stn ≦ 4000 | −100 |
| 4000 < Stn | 0 |
FIG.26A
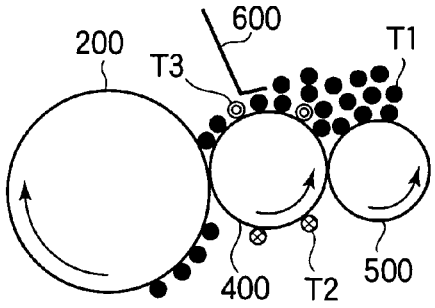
WHEN PRINT DUTY IS HIGH
FIG.26B
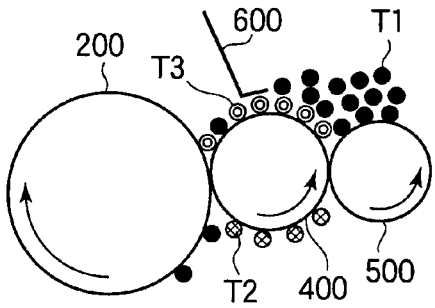
WHEN PRINT DUTY IS LOW

IMAGE FORMING APPARATUS AND METHOD FOR APPLYING TRANSFER VOLTAGE IN THE IMAGE FORMING APPARATUS

BACKGROUND OF THE INVENTION

1. Field of the Invention

The present invention relates to an electrophotographic image forming apparatus such as a copying machine, a facsimile machine, and a printer.

2. Description of the Related Art

A conventional electrophotographic image forming apparatus performs processes of charging, exposing, developing, transferring, and fixing in sequence, thereby printing an image. A charging section charges a photoconductive drum to a predetermined potential, and an exposing section selectively irradiates the charged surface with light to form an electrostatic latent image on the photoconductive drum. The electro static latent image is then developed with toner into a toner image. The toner image is then transferred onto a recording medium.

The toner is triboelectrically charged so that the charged toner is attracted to the electrostatic latent image, thereby developing the electrostatic latent image into the toner image. The toner image is then transferred with the aid of static electricity onto the recording medium. Therefore, the amount of charge on the toner is one of the factors that greatly affect the quality of the image printed on the print medium.

The transfer current that flows during the transfer of a toner image onto the recording medium is another factor that affects the quality of printed image. Japanese Patent Laid-Open No. H10-301344 discloses an invention in which the transfer voltage is controlled for good print quality. The invention makes use of the fact that transfer current flowing through a transfer roller greatly affects the quality of a printed image.

FIGS. 26*a* and 26B illustrate the relation between the print duty of a printed image and the amount of charge on the toner. A developing blade is in pressure contact with a developer bearing body or a developing roller 400 which in turn rotates in contact with a developer supplying member or a supplying roller 500. FIG. 26A illustrates the relation when an image is printed at high print duty. FIG. 26B illustrates the relation when an image is printed at low print duty. In this invention, the term "print duty" covers the amount of toner used when an image is printed on a page of recording medium, or a population density of dots printed on a page of recording medium. A developer material or toner T1 is triboelectrically charged with the aid of the friction between the developing roller 400 and the supplying roller 500. Then, the toner T1 is attracted to the electrostatic latent image, thereby developing the electrostatic latent image. When printing is performed at high print duty, residual toner T2 remains on the developing roller 400 if the toner T1 fails to be attracted to the electrostatic latent image. The amount of the toner T2 is relatively small. When printing is performed at low print duty, a relatively large amount of the residual toner T2 remains on the developing roller 400.

The toner T2 remaining on the developing roller 400 tends to be further charged due to the friction between the developing roller 400 and the supplying roller 500, becoming overcharged toner T3. The amount of overcharged toner T3 is larger when printing is performed at low print duty than when printing is performed at high print duty. As a result, the total amount of charge acquired by the toner increases gradually.

FIG. 27 illustrates the relation between the amount of toner remaining on the developing roller 400 and the amount of charge acquired by the toner, assuming that printing is performed at low print duty and only a relatively small amount of toner remains on the developing roller 400. It is assumed that the toner T1 is normally charged to a negative polarity in the present invention. Thus, an increase in the amount of charge on the toner implies that the amount of charge on the toner is large in absolute value. The toner T2 remaining on the developing roller 400 is subjected to the friction between the developing roller 400 and the supplying roller 500, being further charged to become toner T3 triboelectrically. If the amount of toner T2 remaining on the developing roller 400 is small, the amount of toner T1 supplied to the supplying roller 500 is also small. Thus, the amount of overcharged toner T3 is larger when the amount of toner T2 is smaller than when the amount of toner T2 is large. As a result, the amount of charge on the toner increases.

FIG. 28 illustrates the relation between the increase in the amount of charged on the toner and the occurrence of poor transfer performance. The toner T1 supplied to the electrostatic latent image formed on the photoconductive drum 200 is transferred onto paper P being carried on a transport belt 180. The paper P having the toner T5 thereon is transported to a fixing unit. If the amount of charge on the toner T3 is large, electric discharge occurs before the toner T5 is transferred onto the paper P, such that the toner T5 is charged to a positive polarity. The positively charged toner is not transferred onto the paper P, causing the toner to be absent from the printed image. The absence of toner is depicted at Y referred to as poor transfer performance.

SUMMARY OF THE INVENTION

An object of the invention is to provide an electrophotographic image forming apparatus in which a transfer voltage is corrected for good transfer performance.

Another object of the invention is to provide an electrophotographic image forming apparatus in which poor transfer performance is prevented and stable, reliable print quality may be obtained.

An image forming apparatus is such that a developer image is transferred by a transfer section from an image bearing body onto a recording medium. The image forming apparatus includes a memory, an apparatus usage information obtaining section, and a transfer voltage correcting section. The memory stores correction values for a transfer voltage, the correction values corresponding to changes in an operation status of the image forming apparatus. The apparatus usage information obtaining section obtains information on the operation status. The transfer voltage correcting section corrects the transfer voltage based on the correction values and the information on the operation status.

A method of applying a transfer voltage to a transfer section that transfers a developer image from an image bearing body onto a recording medium includes the steps of generating a correction value based on which the transfer voltage is corrected in accordance with the operation status obtaining apparatus usage information, and correcting the transfer voltage based on the correction value and the apparatus usage information.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 7 is a flowchart illustrating the operation of the printer immediately after the printer is turned on;

FIG. 18 illustrates the comparison of the first embodiment with the conventional printer in terms of print results;

FIG. 19 illustrates the conditions under which the experimental results shown in FIGS. 17 and 18 were measured;

FIG. 25 is a Vtn table that lists minimum correction values of transfer voltage;

FIGS. 26A and 26B illustrate the relation between the print duty of a printed image and the amount of charge on the toner;

DETAILED DESCRIPTION OF THE INVENTION

First Embodiment

{Construction}

Figure 1:
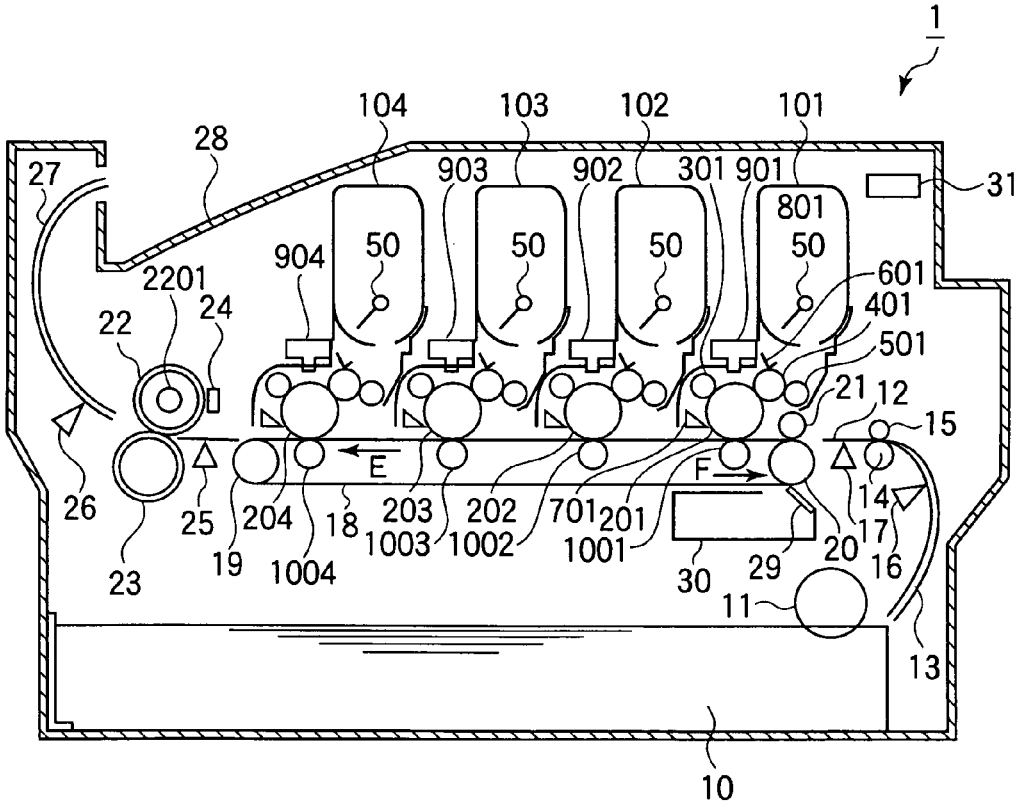
FIG. 1 illustrates a pertinent portion of a printer of a first embodiment.

FIG. 1 illustrates a pertinent portion of a printer 1 of a first embodiment. The printer 1 is an image forming apparatus capable of printing print data received from a host apparatus on a recording medium or paper P.

A paper cassette 10 is mounted to a lower portion of the printer 1 and is quickly releasable from the printer 1. A hopping roller 11 is disposed over the paper cassette 10. A paper transport path 12 describes generally an "S" starting from the hopping roller 11 and ending at a discharging roller (not shown) in the vicinity of a stacker 28. Located along the transport path 12 are a guide 13, a registry roller 14, a transport belt 18, a heat roller 22, and a guide 27. A pinch roller 15 is in pressure contact with the registry roller 14. A sensor 16 is disposed upstream of the registry roller 14 with respect to the direction of travel of the paper P, and a sensor 17 is disposed downstream of the registry roller 14. The transport belt 18 is disposed about a drive roller 19 and a driven roller 20. An attraction roller 21 is in pressure contact with the driven roller 20.

Four printing mechanisms or print engines 101-104 are disposed along the transport path 12 and over the transport belt 18. The heat roller 22 is in pressure contact with the pressure roller 23. A sensor 25 is disposed upstream of the heat roller 22, and a sensor 26 is disposed downstream of the heat roller 22. The stacker 28 is formed on the outer surface of the chassis of the printer 1. A cleaning blade 29 is disposed at a position where the transport belt 18 is sandwiched between the cleaning blade 29 and the driven roller 20, and scrapes the waste toner off the transport belt 18 into a waste toner tank 30. An environment condition detecting section or an environment sensor 31 is disposed in the printer 1.

The paper cassette 10 holds a stack of paper therein, and is mounted to the lower portion of the printer 1 and is quickly releasable from the printer 1. A separator (not shown) is disposed over the paper cassette 10, and causes the top page of the stack of paper to advance into the guide 13 on a page-by-page basis. The hopping roller 11 is driven in rotation by a hopping motor 36 to advance the top page of the paper P into the guide 13, so that the paper P advances along the guide 13 to the registry roller 14.

The registry roller 14 is driven by the registry motor 37 (FIG. 2) to rotate, and cooperates with the pinch roller 15 to correct skew of the paper P. The sensors 16 and 17 detect the position of the paper P.

The transport belt 18 attracts the paper P by the Coulomb force, and transports the paper P along the transport path 12. The drive roller 19 is driven by a belt motor 38 (FIG. 2) to rotate, thereby driving the transport belt 18 to run in a direction shown by arrow E (FIG. 1). The driven roller 20 cooperates with the drive roller 19 to support the transport belt 18 in tension in a direction parallel to the directions shown by arrows E and F. The driven roller 20 cooperates with the attraction roller 21 with the transport belt 18 sandwiched between them. The paper P advances through the print engines 101-104 while being electrostatically attracted to the transport belt 18.

The print engines 101-104 form a black (K) image, a yellow (Y) image, a magenta (M) image, and a cyan (C) image, respectively. The print engines 101-104 each employ an LED type exposing unit. The print engines 101-104 are mounted to the printer 1, and are quickly releasable. The print engines 101-104 will be described later in more detail.

LED heads 901-904 each include LED arrays, drive ICs (not shown) for electrically driving the LED arrays, a PCB that supports shift registers for holding the image data, and a SELFOC lens array (not shown). The LED heads 901-904 receive a black image signal, a yellow image signal, a magenta image signal, and a cyan image signal, respectively, from a host interface 32, and emit light in accordance with these image signals. The SELFOC lens arrays focus the light emitted from the LED arrays of the LED heads 901-904 on the surfaces of corresponding photoconductive drums 201-204, respectively.

The transfer rollers 1001-1004 are in pressure contact with the corresponding photoconductive drums 201-204 with the transport belt sandwiched between the photoconductive drums and the corresponding transfer rollers. A transferring voltage generator 45 (FIG. 2) supplies a transfer voltage to the transfer rollers 1001-1004, thereby transferring the toner images formed on the photoconductive drums 201-204 onto the paper P one over the other in registration.

Figure 2:
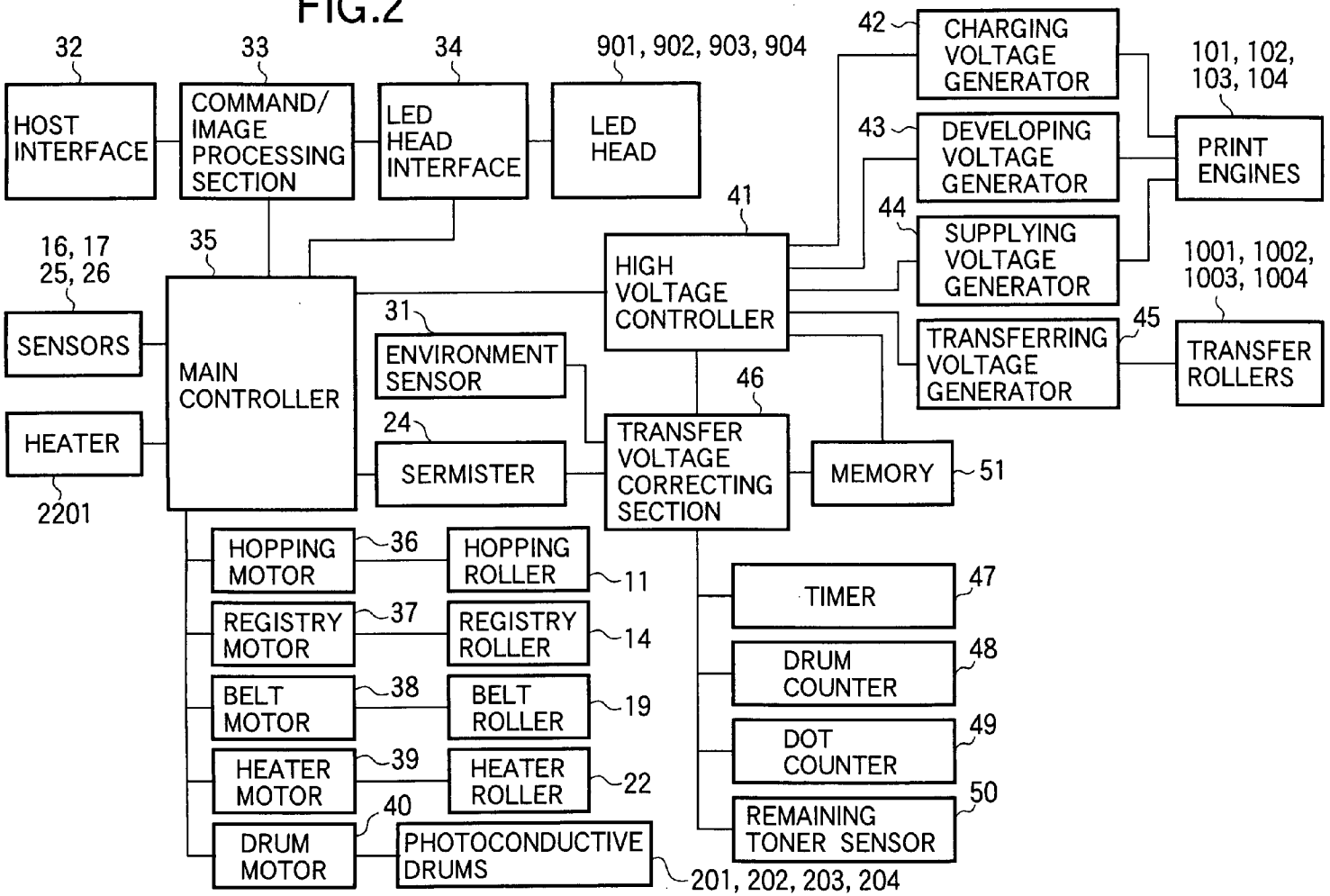
FIG. 2 is a block diagram illustrating various sections of the first embodiment.

The heat roller 22 is generally in the shape of a hollow cylinder, and incorporates a heater 2201 such as a halogen lamp. A heater motor 39 drives the heat roller 32 in rotation. The pressure roller 23 rotates in pressure contact with the heat roller 22. A thermistor 24 is disposed in proximity to the surface of the heat roller 22, and detects the surface temperature Tf of the heat roller 22. The output of the thermistor 24 is sent to a main controller 35 (FIG. 2). The main controller 35 controls the heater 2201 to turn on and off in accordance with the output of the thermistor 24, thereby maintaining the surface temperature Tf of the heat roller 22. The heat roller 22, heater 2201, pressure roller 23 and thermistor 24 cooperate with one another to form a fixing unit that heats the toner on the paper P to fuse, thereby fixing the toner image.

The sensor 25 watches for the separation of the paper P from the transport belt 18, and detects the trailing end of the paper P. The sensor 26 watches for wrapping of the paper P around the heat roller 22 and jamming of the paper P at the fixing unit. The guide 27 is disposed downstream of the sensor 24, and guides the paper P to the stacker 28. The paper P passes through the fixing unit, and then advances along the guide 27 to the stacker 28.

The cleaning blade 29 scrapes the residual toner off the transport belt 18 into the waste toner tank 30. The waste toner tank 30 is a hollow body, and is disposed to receive the residual toner scraped off by the cleaning blade 29. The environment sensor 31 detects the environment temperature Te, i.e., temperature outside of the printer 1 and environment humidity He, i.e., humidity outside of the printer 1.

{Print Engines}

The print engines 101-104 will be described. The print engines 101-104 form a black (K) toner image, a yellow (Y) toner image, a magenta (M) toner image and a cyan (C) toner image, respectively. Each of the print engines 101-104 may be substantially identical; for simplicity only the operation of the print engine 101 for forming black images will be described, it being understood that the other print engines 102-104 may work in a similar fashion.

A photoconductive drum 201 is rotatably supported on a frame of the print engine 101, and serves as an image bearing body. A charging roller 301 is in pressure contact with the photoconductive drum 201 to form a predetermined nip therebetween, and rotates to uniformly charge the circumferential surface of the photoconductive drum 201. The LED head 901 of the exposing unit illuminates the charged surface of the photoconductive drum 201. A developing member or a developing roller 401 is in pressure contact with the photoconductive drum 201 to supply a developer material or toner to an electrostatic latent image formed on the circumferential surface of the photoconductive drum 201, thereby developing the electrostatic latent image into a toner image. A supplying roller 501 is in pressure contact with the developing roller 401 to form a predetermined nip therebetween, and rotates to supply the toner to the developing roller 401. A developing blade 601 is in pressure contact with the developing roller 401 to form a predetermined nip, and forms a thin layer of the toner on the developing roller 401. A neutralizer 701 irradiates the charged surface of the photoconductive drum 201 with light after transferring the toner image onto the paper P, thereby neutralizing the surface of the photoconductive drum 201. A developer holding portion or a toner cartridge 801 holds black developer material or black (K) toner, and supplies the black toner into a toner reservoir of the print engine 101. The developing roller 401 and the supplying roller 501 forms a developer charging section in which the toner is triboelectrically charged by means of the friction between the developing roller 401 and the supplying roller 501.

The photoconductive drum 201 is driven in rotation by a drum motor 40. The LED head 901 illuminates the charged surface of the photoconductive drum 201 to form an electrostatic latent image of black (K).

The charging roller 301 receives a charging voltage from a charging voltage generator 42, and charges the circumferential surface of the photoconductive drum 201 uniformly.

The developing roller 401 receives a developing voltage from a developing voltage generator 43, and supplies the toner charged by the developing voltage to the electrostatic latent image formed on the photoconductive drum 201.

The supplying roller 501 receives a supplying voltage from a supplying voltage generator 44, and supplies the toner charged by the supplying voltage to the developing roller 401. The developing blade 601 is in the shape of a thin blade-like member, and forms a thin layer of toner on the developing roller 401. The neutralizer 701 illuminates the surface of the photoconductive drum 201 to neutralize the surface of the photoconductive drum 201.

A toner cartridge 801 is a hollow body that holds black toner therein, and incorporates an agitator (not shown) therein. The toner in the toner cartridge 801 falls by gravity onto the supplying roller 501 present in a toner reservoir of the print engine 101.

{Controlling Sections}

FIG. 2 is a block diagram illustrating various sections of the first embodiment. A host interface 32 physically interfaces with a host computer (not shown), and incorporates a cable connector and a communication chip (not shown) for, for example, LAN. A command/image processing section 33 analyzes commands and image data received via the host interface 32 from the host computer. The command/image processing section 33 includes primarily a micro processor, a RAM, and a special hardware, (all not shown). The microprocessor cooperates with the special hardware to render the image data into a bitmap by using the RAM as a working area. The command/image processing section 33 also performs the overall control of the printer 1.

An LED head interface 34 includes primarily a semi-custom LSI and a RAM (all not shown), and processes the bit map (image data) according to the interfaces for the LED heads 901-904.

According to the commands received from the command/image processing section 33, the main controller 35 analyzes transport status signals received from the sensors 16, 17, 25, and 26 and surface temperature signal representative of the surface temperature of the heat roller 22 received from the thermistor 24, thereby controlling the hopping motor 36, registry motor 37, belt motor 38, heater motor 39, and drum motor 40 and the temperature of the heater 2201 based on the analysis.

The hopping motor 36, registry motor 37, belt motor 38, heater motor 39, and drum motor 40 are controlled by their corresponding drivers. A high voltage controller 41 controls the charging voltage, developing voltage, supplying voltage for the rollers incorporated in the print engines 101-104. A transfer voltage correcting section 46 determines the values of transfer voltage and stores the values of the transfer voltage into a memory 51. The high voltage controller 41 reads the values of transfer voltage from the memory 51, thereby controlling the transfer voltages applied to the transfer rollers 1001-1004 according to the value during a printing operation.

The transfer voltage correcting section 46 analyzes the following signals to calculate a total correction value given by Vq×Q, which will be described later; an amount-of-time-of-operation signal outputted from an operation time measuring section or a timer 47; an environment temperature/humidity signal outputted from the environment sensor 31 indicating the temperature and humidity outside of the printer 1; the counts of a drum counter 48 and a dot counter 49 that cooperate with each other to serve as a print duty obtaining section; and a remaining toner signal outputted from a remaining toner sensor 50. Then, the corrected value of the transfer voltage is stored into the memory 51.

Figure 8:
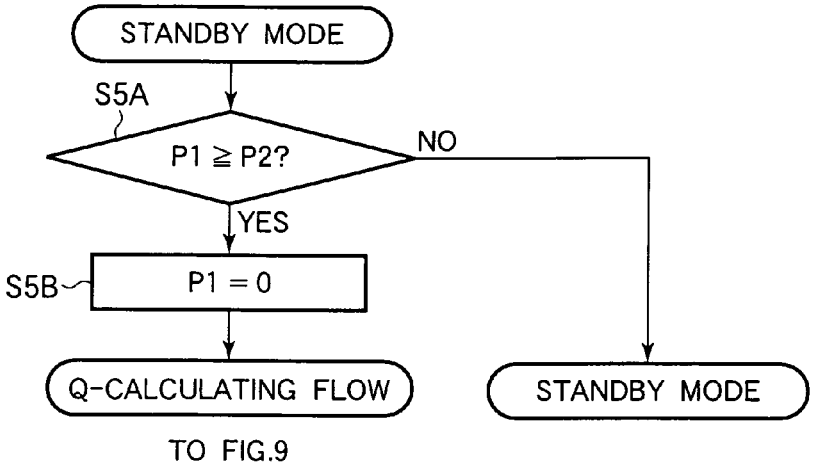
FIG. 8 is a flowchart illustrating the operation of the printer in a standby mode.

The timer 47 starts counting shortly after the printer 1 is turned on, and is reset at step S5B shown in FIG. 8. The drum counter 48 counts the number of rotations of each of the photoconductive drums 201, 202, 203, and 204. The drum counter 48 also serves as a number-of-printed-pages obtaining section. The number of rotations corresponds to the number of printed pages. The dot counter 49 counts the number of dots in image data which is rendered into a bitmap by the command/image processing section 33. The dot counter 49 also serves as a number-of-printed-dots obtaining and storing section. The count of the dot counter 49 corresponds to the number of printed dots. The remaining toner sensor 50 is provided in each toner cartridge, and serves as a remaining developer detecting section that detects a remaining amount of toner in the toner cartridge. The remaining toner sensor 50 may also be disposed in the path of toner in the print engines, i.e., somewhere from inside of the toner cartridge to the photoconductive drum, provided that the remaining toner sensor 50 is upstream of the supplying roller with respect to movement of the toner within the toner reservoir. The number-of-printed-page obtaining section, the number-of-printed-dots obtaining and storing section, the print duty obtaining section or the combination of the drum counter 48 and the dot counter 49, the remaining developer detecting section, and the environment condition detecting section or environment sensor 31 cooperate with one another to form an apparatus usage information obtaining section.

Figure 3:
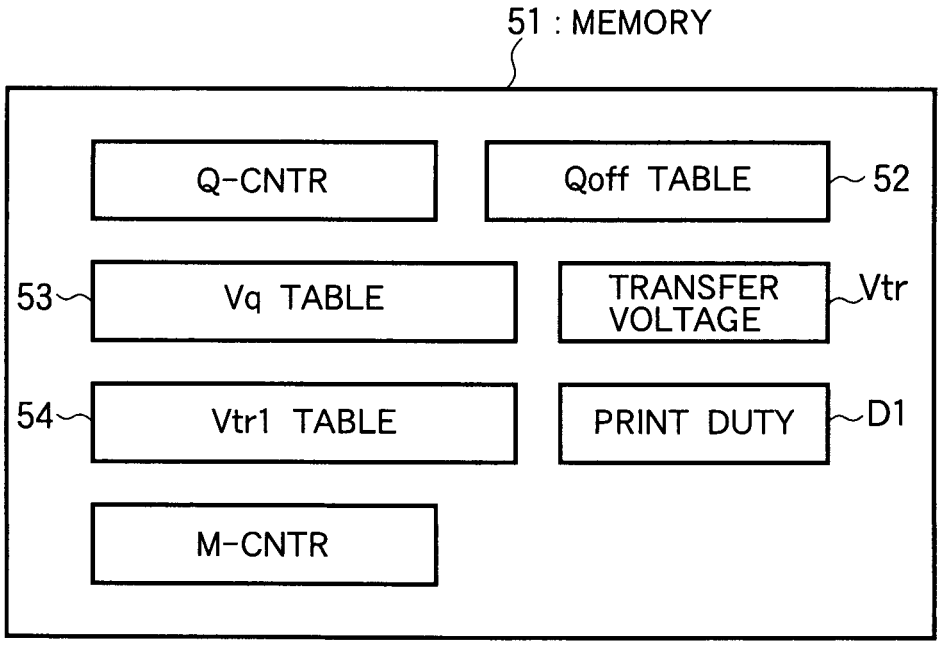
FIG. 3 is a block diagram illustrating a memory.

The memory 51 stores the corrected values of the transfer voltage. The corrected value of the transfer voltage may be read from the memory 51 and written into the memory 51 as required. FIG. 3 is a block diagram illustrating the memory 51. The memory 51 holds the values of transfer voltage for the respective transfer rollers 1001-1004 used in an actual printing operation, a counter Q-CNTR, a Qoff table 52 (FIG. 13), a Vq table 53 (FIG. 15), a Vtr1 table 54 (FIG. 16), and a counter M-CNTR. The Qoff table 52 is used to determine the value of a counter correction status Qoff which is used in calculating the total correction value given by Vq×Q. The counter correction status Qoff is a value by which the count of the counter Q-CNTR is decremented. The counter Q-CNTR is a modulo 5 counter that counts from 0 to 4, and the count of the counter Q-CNTR is used in calculating the corrected transfer voltage Vtr. The counter Q-CNTR resides in the memory 51 and is not reset after the printer 1 is turned off. The Qoff table 52 lists the values of Qoff according to an elapsed time Poff during which the printer 1 is left idle after the last printing operation. The counter M-CNTR effectively counts the time elapsed since the Q-CNTR was incremented or decremented last time. The elapsed time is expressed in terms of the number of predetermined time intervals. The predetermined time interval is selected to be 30 minutes in the first embodiment. The count M1 of the M-CNTR is used to detect the timing at which the counter Q-CNTR should be decremented. The memory 51 holds a print duty D1.

Referring back to FIG. 2, the charging voltage generator 42 generates and shuts off the charging voltage to be supplied to the charging rollers of the respective print engines 101-104 under control of the high voltage controller 41. Likewise, the developing voltage generator 43 generates and shuts off the developing voltage to be supplied to the developing rollers of the respective print engines 101-104 under control of the high voltage controller 41.

The supplying voltage generator 44 generates and shuts off the supplying voltage to be supplied to the supplying rollers of the respective print engines 101-104 under control of the high voltage controller 41. The transferring voltage generator 45 generates and shuts off the transferring voltage to be supplied to the transfer rollers 1001-1004 of the respective print engines 101-104 under control of the high voltage controller 41.

{Optimum Value of Transfer Voltage}

The optimum value of transfer voltage of the invention will be described. Optimum value of transfer voltage refers to a value of transfer voltage at which good transfer of an image may be performed or a transfer voltage at which the toner is difficult to be absent from a printed image. Optimum value of transfer voltage varies depending on the amount of charge on the toner and the remaining amount of toner, and is therefore measured by experiment.

Continuous Printing

In the present invention, continuous printing is defined as an operation mode of a printer in which the number of rotations of a photoconductive drum is large than 150 per 30 minutes.

Figure 4A:
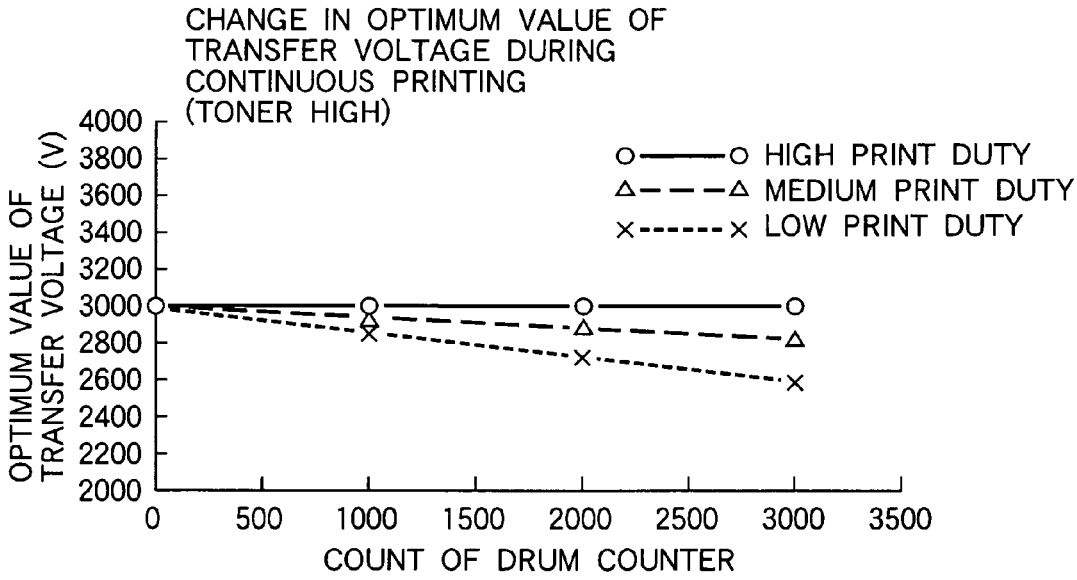
FIG. 4A is a graph of the change in optimum value of transfer voltage during continuous printing when a relatively large amount of toner remains in a toner cartridge.
Figure 4B:
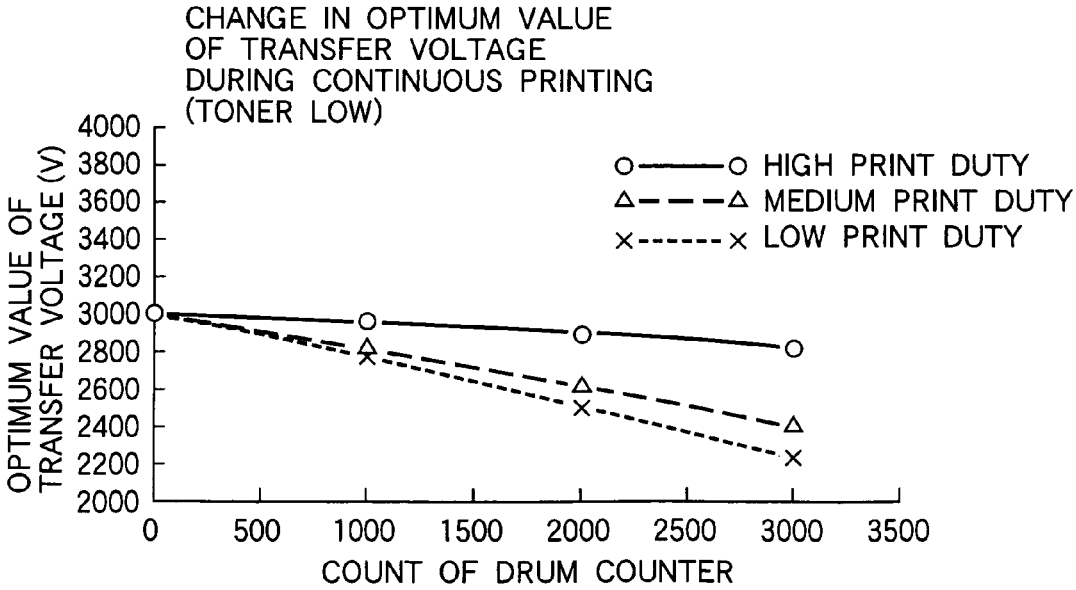
FIG. 4B is a graph of the change in optimum value of transfer voltage during continuous printing when a relatively small amount of toner remains in the toner cartridge.

FIGS. 4A and 4*b* are graphs of the optimum value of transfer voltage when continuous printing is performed. FIG. 4A is a graph illustrating the change in optimum value of transfer voltage during continuous printing when a relatively large amount of toner (i.e., toner high) remains in the toner cartridge. FIG. 4B is a graph illustrating the change in optimum value of transfer voltage during continuous printing when a relatively small amount of toner (i.e., toner low) remains in the toner cartridge. As previously described, poor transfer performance may be caused by the increase in the amount of charge on the toner particles due to variations in print duty during continuous printing. An experiment was conducted to find optimum values of transfer voltage at which no poor transfer performance is resulted. The results are shown in FIGS. 4A and 4B.

Print duty is the ratio of the number of dots that are printed per unit time to the number of rotations of the photoconductive drum made per unit time. High print duty is 3750 (equivalent to an image density of 25%) and intermediate duty is 2250 (equivalent to an image density of 15%), and low duty is 750 (equivalent to an image density of 5%). In the present invention, when a remaining amount of toner is more than 20% of the capacity of the toner cartridge, the remaining amount of toner is "large." Likewise, when a remaining amount of toner is equal to or less than 20% of the capacity of the toner cartridge, the remaining amount of toner is "small." Thus, the number of printed pages per unit time is large in continuous printing. FIG. 4 shows that the lower the print duty is, the lower the optimum value of transfer voltage becomes with increasing number of printed pages in continuous printing. Also, the smaller the remaining amount of toner is, the lower the optimum value of transfer voltage becomes with increasing number of printed pages in continuous printing.

Intermittent Printing

In the present invention, intermittent printing is defined as an operation mode of the printer in which the total number of rotations of a photoconductive drum is less than 150 rotations per 30 minutes.

Figure 5A:
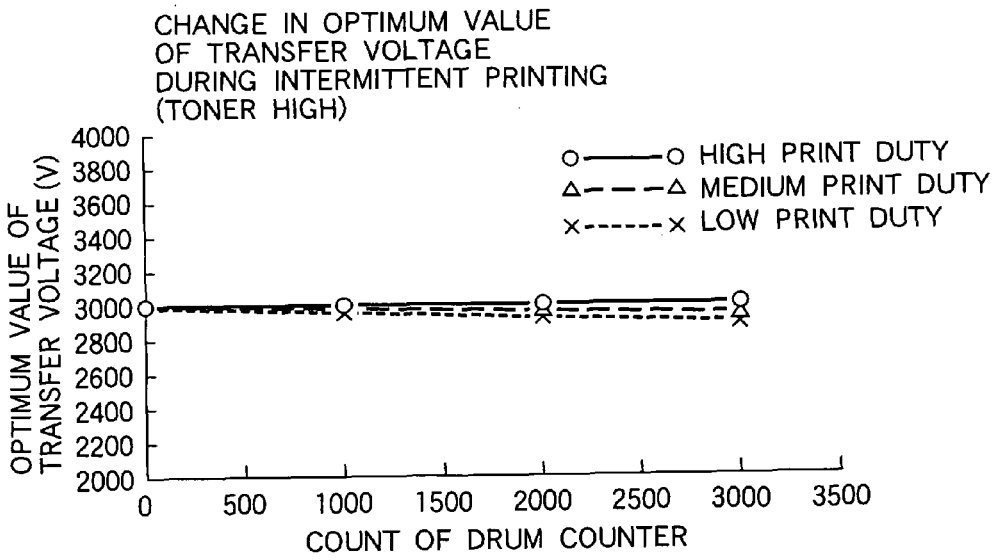
FIG. 5A is a graph of the change in optimum value of transfer voltage during intermittent printing when a relatively large amount of toner remains in the toner cartridge.
Figure 5B:
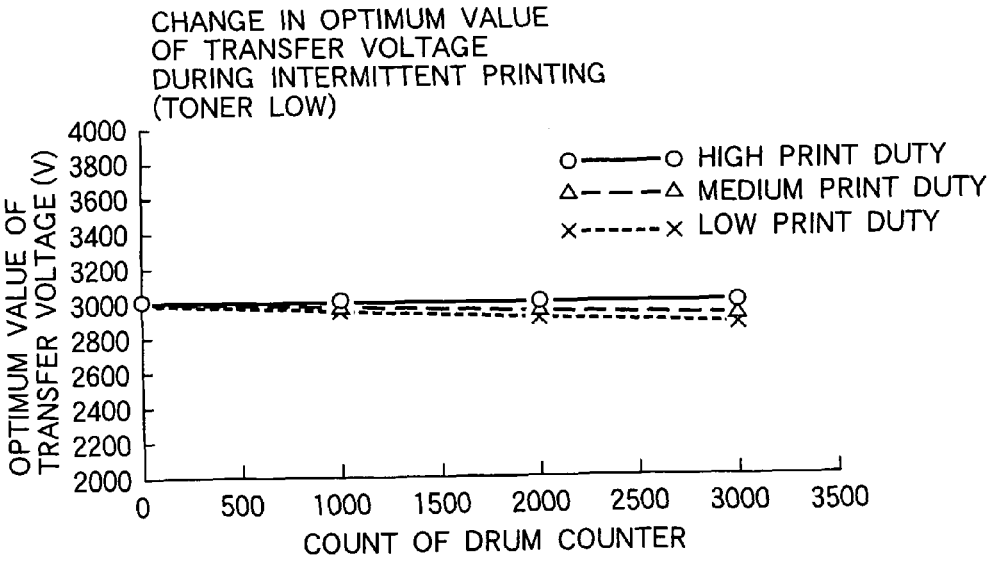
FIG. 5B is a graph of the change in optimum value of transfer voltage during intermittent printing when a relatively small amount of toner remains in the toner cartridge.

FIGS. 5A and 5B are graphs of optimum value of transfer voltage when intermittent printing is performed. FIG. 5A is a graph illustrating the change in optimum value of transfer voltage during intermittent printing when a relatively large amount of toner (i.e., toner high) remains in the toner cartridge. FIG. 5B is a graph illustrating the change in optimum value of transfer voltage during intermittent printing when a relatively small amount of toner (i.e., toner low) remains in the toner cartridge. As previously described, poor transfer performance may be caused by the increase in the amount of charge on the toner particles due to variations in print duty during intermittent printing. An experiment was conducted to find optimum value of transfer voltages that dot not exhibit poor transfer performance. The results are shown in FIG. 5A. It is to be noted that the change in optimum value of transfer voltage is much smaller in intermittent printing than in continuous printing.

Figure 6:
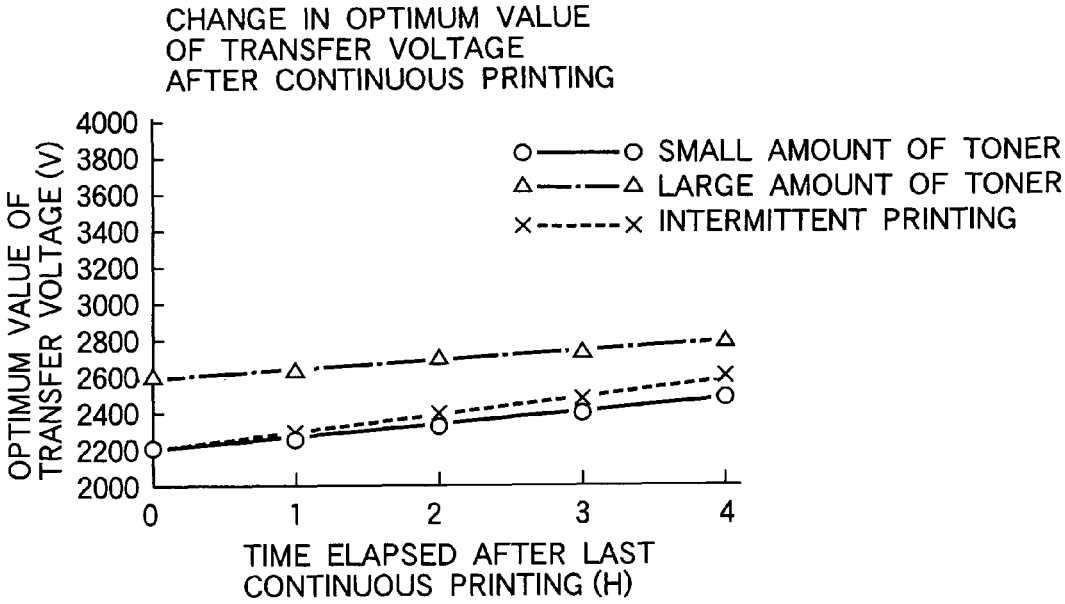
FIG. 6 is a graph of the optimum value of transfer voltage versus the period of time during which the printer remains turned on but is left idle after continuous printing performed at low print duty.

FIG. 6 is a graph of the optimum value of transfer voltage versus the period of time during which the printer 1 remains turned on but is left idle after continuous printing performed at low print duty. A solid line represents the optimum value of transfer voltage if printing is resumed a predetermined time after continuous printing has been performed at a low print duty and with a small remaining amount of toner. Likewise, a dot-dashed line represents the optimum value of transfer voltage if printing is resumed a predetermined time after continuous printing has been performed at a low print duty and with a large remaining amount of toner. A dotted line represents the optimum value of transfer voltage when printing is performed intermittently a predetermined time after continuous printing has been performed at a low print duty with a small remaining amount of toner.

Referring to FIG. 6, leaving the print engines inoperative for a certain period of time after continuous printing has completed allows the optimum value of transfer voltage (effective in preventing poor transfer performance due to the changes in the amount of charge on the toner) to be gradually restored to what it was before the continuous printing began. Likewise, leaving the print engines idle for a certain period of time after intermittent printing has completed allows the optimum value of transfer voltage (effective in preventing poor transfer performance due to the changes in the amount of charge on the toner) to be gradually restored to what it was before intermittent printing began. As described above, the optimum value of transfer voltage varies depending on the operation status of the printer 1. The operation status is obtained by a usage status obtaining section in the printer 1. The usage status obtaining section is implemented by at least one of the number-of-printed-page obtaining section or drum counter 48, the number-of-printed-dots obtaining and storing section or dot counter 49, the print duty obtaining section or the combination of the drum counter 48 and the dot counter 49, the remaining developer detecting section 50, the environment condition detecting section 31, and a developer status obtaining section or a toner status calculating section 56.

Figure 7:
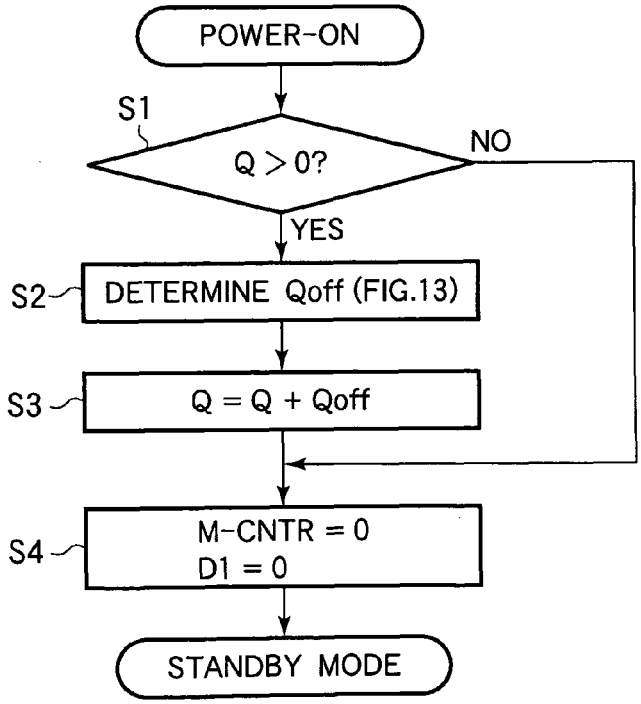

The operation of the first embodiment or a transfer voltage correction process will be described. FIG. 7 is a flowchart illustrating the operation of the printer 1 immediately after the printer 1 is turned on.

The longer the period of time the printer is left turned off after the last printing operation, the more the optimum value of transfer voltage is restored. Therefore, a new value of transfer voltage must be determined in accordance with the time elapsed since the last printing operation.

The flowchart checks the correction status of the transfer voltage immediately after the printer 1 is turned on (step S1), and the time elapsed since the last printing operation, Poff (step S2). The elapsed time Poff may be inferred based on the count of the counter Q-CNTR, the surface temperature Tf of the heat roller 22 detected by the thermistor 24, and the environment temperature Te detected by the environment sensor 31.

At step S1, the transfer voltage correcting section 46 makes a decision to determine whether the count of the counter Q-CNTR is lager than "0." If the answer is not Q>0, the program proceeds to step S4. If the answer is Q>0, then it follows that the printer 1 had been turned off before the optimum value of transfer voltage was restored to its value before continuous printing was started, or that the printer 1 has been turned off before the optimum value of transfer voltage is restored to its value before continuous printing was started. Thus, the program proceeds to step S2 to determine how long has passed since the last printing operation.

At step S2, the transfer voltage correcting section 46 determines a temperature difference T0 between the surface temperature Tf of the heat roller 22 and the environment temperature Te as follows:

$$T0=Tf-Te(^\circ\text{ C.}) \qquad \text{Equation (1)}$$

There is a certain correlation between the temperature difference T0 and the elapsed time Poff. Then, the transfer voltage correcting section 46 refers to the Qoff table 52 to infer an elapsed time Poff corresponding to the obtained T0. Then, the transfer voltage correcting section 46 determines from the Qoff table 52 a counter correction status Qoff (e.g., −1, −2, −3, and −4) corresponding to the thus determined elapsed time Poff.

Figures 12, 13:
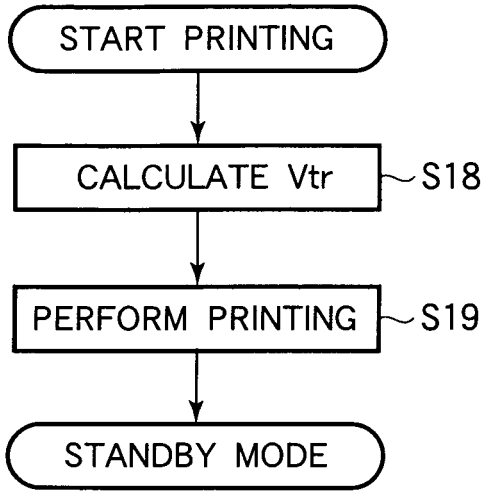
FIG. 12 is a flowchart illustrating the printing operation of the printer.
FIG. 13 illustrates the Qoff table 52 that lists the values of T0, Qoff, and Poff.

FIG. 13 illustrates the Qoff table 52 that lists the values of T0, Qoff, and Poff. For example, if the temperature difference T0 is less than 20° C., the elapsed time Poff is inferred to be longer than 3 hours, so that the value of Qoff is "−4." Poff is the time elapsed since the last printing regardless of whether the printer 1 was turned off after the last printing.

Figures 14, 15:
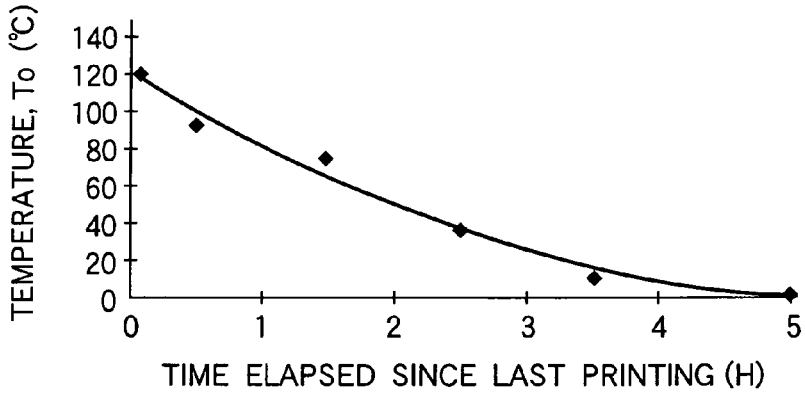
FIG. 14 illustrates the relation between the temperature T0 and the elapsed time Poff, obtained by experiment.
FIG. 15 is a Vq table that lists the minimum correction values Vq.

FIG. 14 illustrates the relation between the temperature T0 and the elapsed time Poff, obtained by experiment. In the first embodiment, the Qoff table 52 shown in FIG. 13 provides a summary of the relation shown in FIG. 14.

At step S3, the transfer voltage correcting section 46 reads the value of the counter correction status Qoff (e.g., −1, −2, −3, −4) from the memory 51, and corrects the count of the counter Q-CNTR as follows:

$$Q=Q+Q\text{off} \quad \text{Equation (2)}$$

where Qoff is the counter correction status, and Q is the count of the counter Q-CNTR.

However, if the Q obtained by equation (2) is Q<0, then Q is always set to "0."

At step S4, the transfer voltage correcting section 46 resets the count M1 of the counter M-CNTR to "0." The count M1 of the M-CNTR is used to detect the timing at which the counter Q-CNTR should be decremented. The transfer voltage correcting section 46 also resets the print duty D1 in the memory 51. The details of the print duty, D1, will be described later. Then, the printer 1 will enter a standby mode after the steps S1-S4 have been executed.

{Standby Mode}

The operation of the printer 1 in the standby mode will be described. FIG. 8 is a flowchart illustrating the operation of the printer 1 in the standby mode. The timer 47 starts counting shortly after the printer 1 is turned on. At step S5A, the transfer voltage correcting section 46 makes a decision to determine whether a time P1 timed by the timer 47 has exceeded a predetermined time P2. Then, the program proceeds to a Q-calculating flow shown in FIG. 9. If NO, the program returns to the standby mode. The timer 47 is reset at step S5B. If YES at step S5A, the predetermined time P2 is a time immediately before poor transfer performance occurs when continuous printing is performed both at a low print duty and at a small remaining amount of toner. In the first embodiment, the time P2 is selected to be 30 minutes.

{Operation for Incrementing and Decrementing Q-CNTR}

Figure 9:
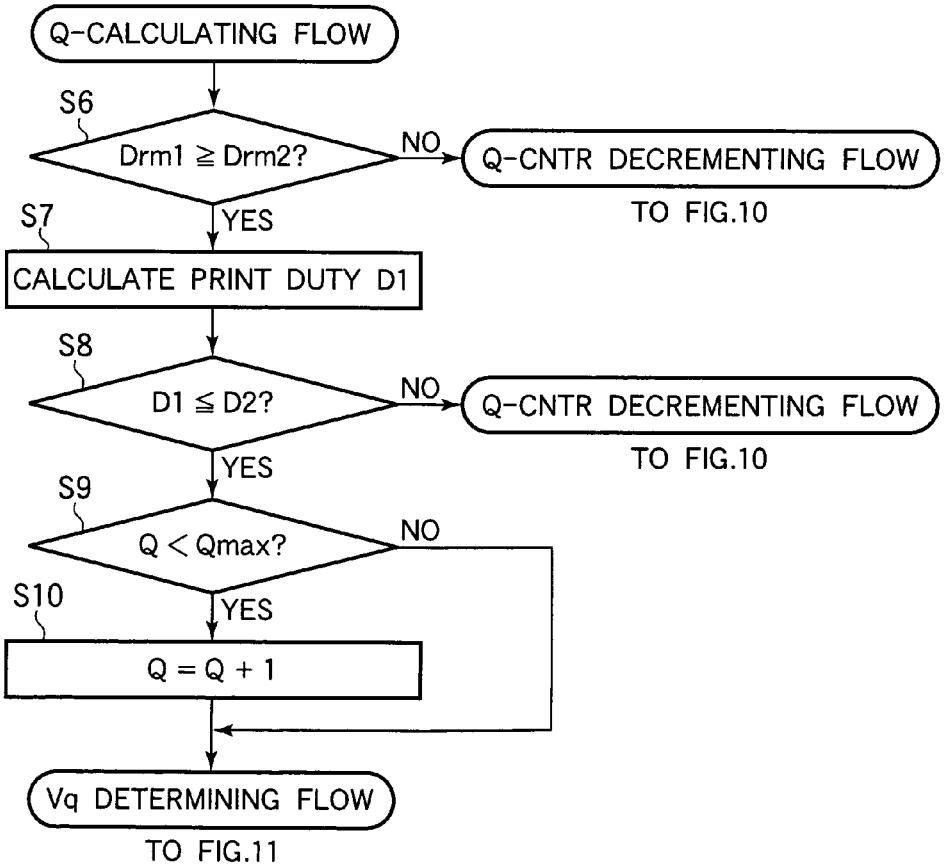
FIG. 9 is a flowchart illustrating the operation for incrementing a counter Q-CNTR.
Figure 10:
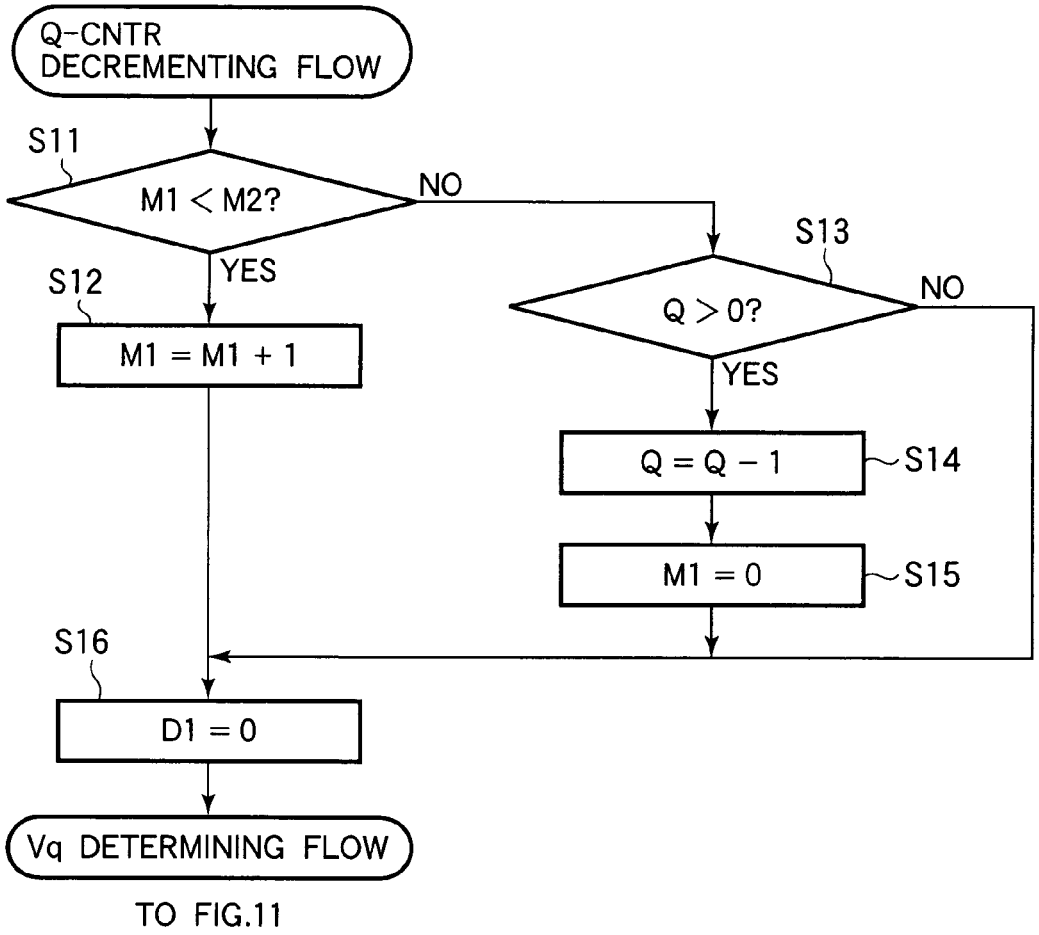
FIG. 10 is a flowchart illustrating the operation for decrementing the counter Q-CNTR.

Next, the operation of the counter Q-CNTR when the answer is YES at step 5A will be described. FIGS. 9 and 10 are flowcharts illustrating the operation for incrementing and decrementing the counter Q-CNTR, respectively.

At step S6, the transfer voltage correcting section 46 makes a decision to determine whether the number of rotations of the photoconductive drum, Drm1, is equal to or larger than a predetermined number of rotations, Drm2. Drm1 is the cumulative number of rotations of the photoconductive drum until the time P1 reaches P2. If the answer is Drm1≧Drm2 (YES at S6), the program proceeds to step S7. If the answer is not Drm1≧Drm2 (NO at S6), the program proceeds to the Q-CNTR decrementing flow in which the counter Q-CNTR is decremented. In the first embodiment, it is assumed that Drm2 is selected to be "150" for the predetermined time P2 taking into account the fact that the number of rotations of the photoconductive drum 201 was "150" when an optimum value of transfer voltage was restored after performing intermittent printing as shown in FIG. 6.

At step S7, the transfer voltage correcting section 46 calculates the print duty, D1, based on the Drm1 counted by the drum counter 48 and the Dot1 counted by the dot counter 49 using equation (3) as follows.

$$D1=\text{Dot1}/Drm1 \quad \text{Equation (3)}$$

Then, the calculated print duty D1 is stored into the memory 51. At step S8, the transfer voltage correcting section 46 makes a decision to determine whether the print duty is D1≦D2. D2 is a predetermined reference value of print duty, and is selected to be "3000" in the first embodiment. If the answer is D1≦D2 (YES at S8), the program proceeds to step S9. If the answer is not D1≦D2 (NO at S8), the program proceeds to the Q-CNTR decrementing flow.

At step S9, the transfer voltage correcting section 46 makes a decision to determine whether the count Q of the counter Q-CNTR is Q<Qmax. If the answer is Q<Qmax (YES at S9), the program proceeds to S10. If the answer is not Q<Qmax (NO at S9), the program proceeds to a Vq determining flow shown in FIG. 11. In the first embodiment, the Qmax is selected to be "4."

At step S10, the transfer voltage correcting section 46 increments the count Q of the counter Q-CNTR by "1" and then proceeds to the Vq determining flow.

{Q-CNTR Decrementing Flow}

FIG. 10 is a flowchart illustrating the Q-CNTR decrementing flow. If NO at steps S6 and S8, the program proceeds to the Q-CNTR decrementing flow shown in FIG. 10 in which the counter Q-CNTR is decremented. The subtraction flow will be described with reference to FIG. 10.

At step S11, the transfer voltage correcting section 46 makes a decision to determine whether the count M1 of the counter M-CNTR is smaller than a predetermined count M2. If the answer is M1<M2 (YES at S11), the program proceeds to step S12. If the answer is not M1<M2 (NO at S11), the program proceeds to step S13. The counter Q-CNTR is decremented if count M1 of the counter M-CNTR is equal to or larger than a predetermined count M2. In the first embodiment, the value M2 is selected to be "2." In other words, if the Q-CNTR decrementing flow is executed twice consecutively, or the printer 1 operates such that if the optimum value of transfer voltage continues to change for a period of time of 60 minutes to restore the value of the transfer voltage to what it was before the last continuous printing was performed, the count Q of the counter Q-CNTR is decremented.

At step S11, if the answer is M1<M2, it follows that the P1 has not passed a predetermined time P2 yet. Thus, at step S12, the transfer voltage correcting section 46 increments the count M1 of the counter M-CNTR by "1".

At step S11, if the answer is no M1<M2 (NO at S11), it follows that the P1 has passed the P2, i.e., M1 has exceeded M2. Thus, the steps S13, S14, and S15 are executed.

At step S13, the transfer voltage correcting section 46 makes a decision to determine whether the count Q of the counter Q-CNTR is large than "0." If the answer is Q>0 (YES at S13), the program proceeds to S14. If the answer is not Q>0 (NO at S13), the program proceeds to S16.

At step S14, the transfer voltage correcting section 46 decrements the count Q of the counter Q-CNTR by "1."

At step S15, the transfer voltage correcting section 46 resets the counter M-CNTR to "0."

Figure 11:
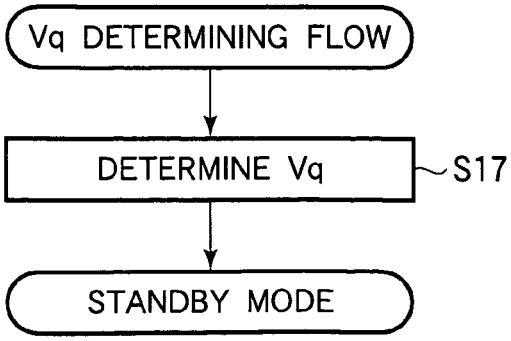
FIG. 11 is a flowchart illustrating the Vq determining flow.

At step S16, the transfer voltage correcting section 46 resets the print duty D1 to "0," and then the program proceeds to the Vq determining flow shown in FIG. 11.

{Vq Determining Flow}

The Vq determining flow will be described. FIG. 11 is a flowchart illustrating the Vq determining flow.

At step S17, the transfer voltage correcting section 46 determines the value of a minimum correction value Vq based on the print duty D1 held in the memory 51, a remaining amount of toner Tn detected by the remaining toner sensor 50, and the environment temperature Te and the environment humidity He detected by the environment sensor 31.

FIG. 15 is a Vq table 53 that lists the minimum correction values Vq. The minimum correction values Vq are determined based on the experimental results shown in FIGS. 4, 5 and 6. The minimum correction value Vq that should be used may be determined by using the Vq table 53. For example, the minimum correction value Vq is "−200 V" if the remaining amount of toner not larger than 20% of the capacity of the toner cartridge, the print duty D1 is not larger than 1500, the environment temperature Te is higher than 25° C., and the environment humidity He is higher than 60%. The program enters the standby mode after having executed steps S6-S17.

{Printing Operation}

Next, the printing operation will be described. FIG. 12 is a flowchart illustrating the printing operation of the printer 1. At step S18, the transfer voltage correcting section 46 calculates from the following equation (4), the optimum value of transfer voltage Vtr used in printing, and then stores the calculated the optimum value of transfer voltage Vtr into the memory 51.

$$Vtr=Vtr1+Vq\times Q \quad (4)$$

where Vtr is the transfer voltage (i.e., transfer voltage actually used in printing), Vtr1 is a basic transfer voltage, Vq is the minimum correction value, and Q is the count of the counter Q-CNTR.

Figures 16, 17:
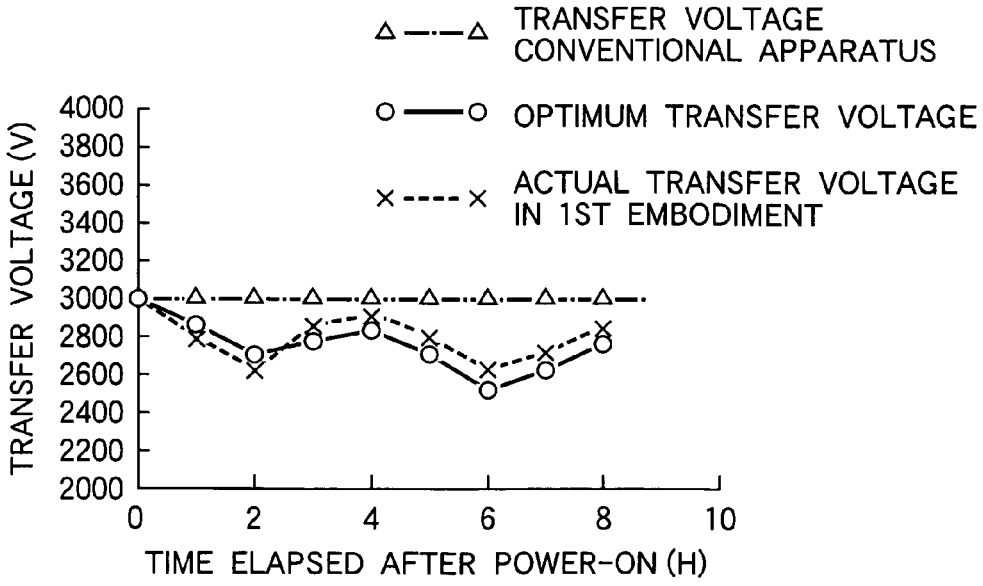
FIG. 16 illustrates a Vtr1 table that lists the values of a basic transfer voltage Vtr1 for ordinary paper and thick paper.
FIG. 17 illustrates an example of the operation of the printer and the operation of a conventional printer.

The quantity given by Vq×Q is the total correction value. The Vtr1 is determined by the type of recording medium, the environment temperature Te, and the environment humidity He. FIG. 16 illustrates a Vtr1 table 54 that lists the values of basic transfer voltage Vtr1 for ordinary paper and thick paper.

The Vtr1 is determined by using the Vtr1 table 54 shown in FIG. 16. The Vtr1 table 54 is stored in the memory 51. For example, if the recording medium is ordinary paper, the environment temperature Te is higher than 25° C., and the environment humidity He is higher than 60%, then the Vtr1 is "3000 V." In the first embodiment, the Vtr1 table 54 lists experimentally determined basic transfer voltages Vtr1 when the amount of charge on the toner is an average amount of charge.

At step S19, the high voltage controller 41 commands the transferring voltage generator 45 to output or shut off the transfer voltage Vtr that should be supplied to the transfer rollers 1001, 1002, 1003, and 1004. If the transfer voltage Vtr is to be outputted, the high voltage controller 41 reads the value of transfer voltage Vtr from the memory 51. Then, the main controller 35 performs printing, and enters the standby mode upon completion of printing.

A description will be given of the comparison of the print results of the conventional printer with those of the printer 1 of the first embodiment. FIG. 17 illustrates an example of the operation of the printer 1 and the operation of a conventional printer: the relationship between the time and the transfer voltage in a conventional printer, the relationship between the time and the optimum value of transfer voltage of the first embodiment, and the relationship between the time and the transfer voltage of the first embodiment. Assume that the printers are turned on and then printing is performed any time upon a command so that the optimum values of transfer voltage vary as shown in FIG. 17. The value of transfer voltage is corrected such that the actual transfer voltage follows the optimum value of transfer voltage as closely as possible. Thus, if the optimum value of transfer voltage varies as depicted in solid line, the actual transfer voltage applied to the transfer roller is controlled to change as depicted in dotted line such that the actual transfer voltage closely follows the optimum value of transfer voltage.

FIG. 18 illustrates the comparison of the first embodiment with the conventional printer in terms of print results. The print results were evaluated by inspection. Symbol "○" indicates "good transfer performance", symbol "X" indicates "poor transfer performance" or "not acceptable transfer performance," and symbol "Δ" indicates "either some poor transfer result may be observed or the transfer result is acceptable."

FIG. 19 illustrates the conditions under which the experimental results shown in FIGS. 17 and 18 were measured. The print duty is selected to be low or intermediate. The number of printed pages is selected to be in the range of 300-1000. Referring to FIG. 19, the printer 1 continues to perform printing for about 2 hours after the power-up, is then left idle for two to three hours, and is then left turned off for 3 to 4 hours before the printer 1 is again powered up and printing is resumed. The remaining amount of toner decreases as shown in FIG. 19.

A conventional printer employs a constant transfer voltage of, for example, 3000 V as shown in FIG. 17. This constant transfer voltage leads to poor transfer performance as shown in FIG. 18. In contrast, the printer 1 of the embodiment is configured to correct the transfer voltage as the optimum value of transfer voltage varies as shown in FIG. 17, so that reliable transfer performance shown in FIG. 18 may be obtained by monitoring the period of time during which the printer is left inoperative after having performed continuous printing at low print duty.

As described above, the transfer voltage correction process of the first embodiment is capable of correcting the transfer voltage in accordance with the change in the amount of charge on the toner that may vary according to the situation in which the printer 1 is used, thereby preventing poor transfer performance from occurring. If a sensor capable of directly detecting the amount of charge on the toner would be available, then the change in the amount of charge on the toner would be detected readily and the transfer voltage would be corrected in accordance with the amount of charge on the toner. However, such a sensor is usually expensive and greatly increases the manufacturing cost. In the first embodiment, the amount of charge on the toner is inferred from a knowledge based on the number of printed pages (detected in terms of the number of rotations of the photoconductive drum, Drm1), the number of printed dots, Dot1, environment temperature and humidity, and the elapsed time P1 since the printer 1 is turned on, detected by devices incorporated in the printer 1. Then, the transfer voltage Vtr is changed to follow the changes in the optimum value of transfer voltage. This implies that no additional, expensive components are required and the printer 1 may operate with the optimum value of transfer voltage without a significant increase in the manufacturing cost of the printer 1.

As described above, the transfer voltage in the first embodiment may be effectively reduced in accordance with the increase in the amount of charge on the toner that may vary depending on the situation in which the printer 1 is used, thereby decreasing the electric field strength to retard electrical discharge. In this manner, the transfer voltage is corrected in accordance with the changes in the optimum value of transfer voltage, thereby preventing poor transfer performance as well as ensuring stable print quality at all times.

Second Embodiment

Toner in the toner reservoir may deteriorate over time, so that the optimum value of transfer voltage for deteriorated toner may deviate from that for unused, fresh toner. A second embodiment is intended to provide a solution to the change in the optimum value of transfer voltage due to deterioration of toner over time. The transfer voltage Vtr in the second embodiment is corrected using a minimum correction value Vq based on the print duty D1, the count of a counter Q-CNTR, Q, and a minimum correction value Vtn based on deterioration of toner.

Figure 20:
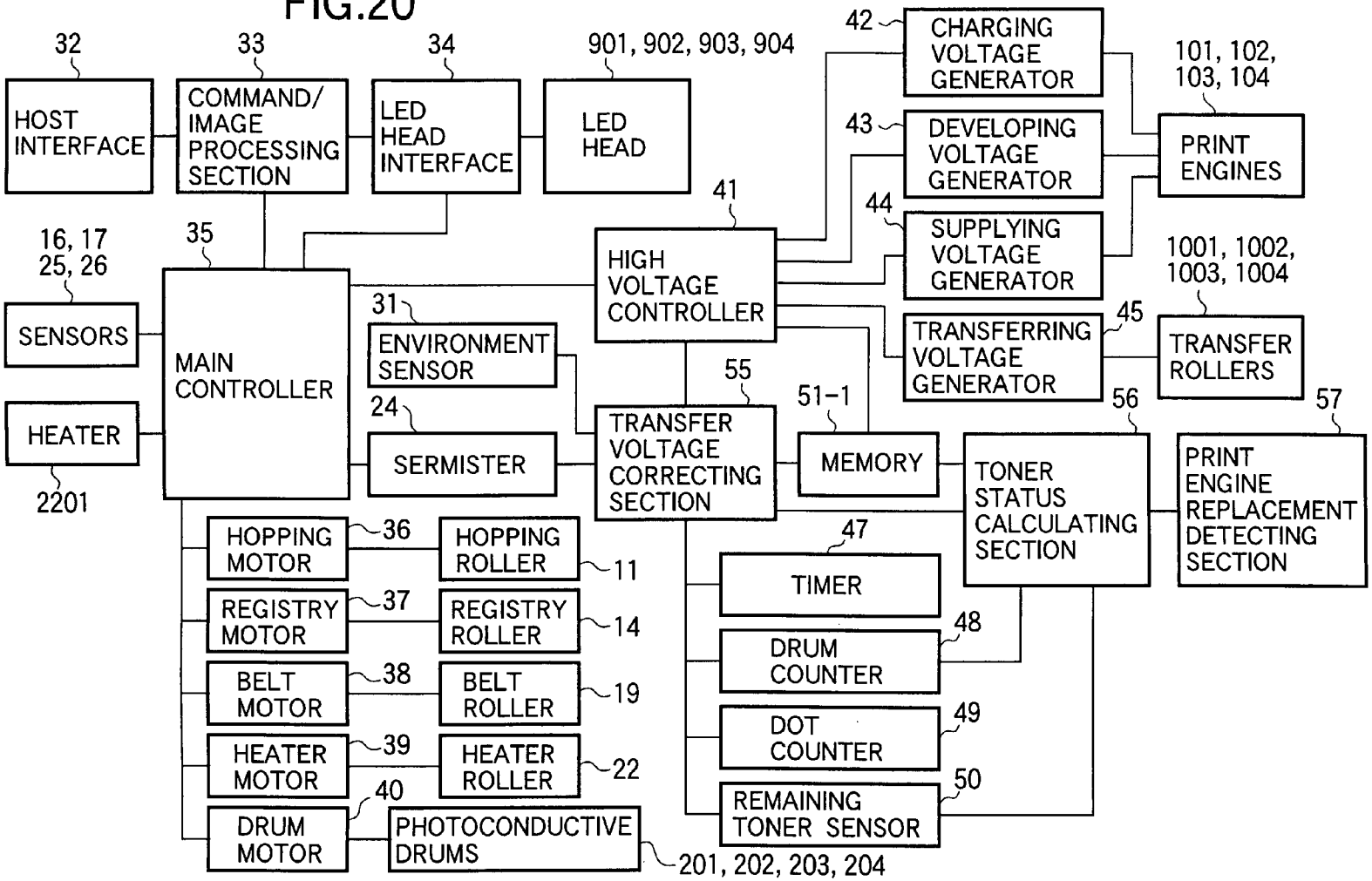
FIG. 20 is a block diagram illustrating various sections of a second embodiment.

FIG. 20 is a block diagram illustrating various sections of the second embodiment. The second embodiment differs from the first embodiment in that a transfer voltage correcting section 55, a developer status obtaining section or a toner status calculating section 56, and a print engine replacement detecting section 57 are used and that a memory 51-1 is employed. The remaining portions of the configuration of the second embodiment are the same as those of the first embodiment.

The transfer voltage correcting section 55 then calculates a total correction value given by Vq×Q+Vtn. The calculation is made based on the operation time signal of the printer 1 outputted from a timer 47, an environment temperature/humidity signal of the printer 1 outputted from an environment sensor 31, the counts of a drum counter 48 and a dot counter 49, and a remaining-amount-of-toner signal. Then, transfer voltage correcting section 55 stores the corrected values of the transfer voltage, Vtr, into the memory 51-1. The toner status calculating section 56 calculates a value or a toner status signal Stn indicative of the degree of deterioration of the toner. The print engine replacement detecting section 57 includes a sensor (not shown) that detects whether any of the print engines 101-104 has been replaced.

{Operation}

Figure 21:
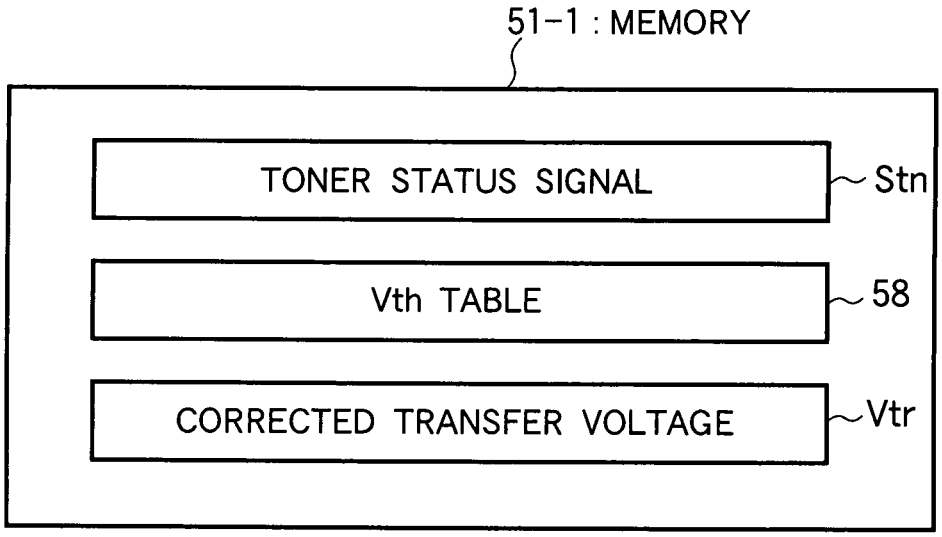
FIG. 21 is a block diagram illustrating the contents of a memory.

FIG. 21 is a block diagram illustrating the contents of the memory 51-1. In addition to the contents in the memory 51 for the first embodiment, the memory 51-1 stores the toner status signal Stn, a Vtn table 58 that lists minimum correction values Vtn.

The operation of the second embodiment will be described. The operation when the printer 1 is turned on and the operation when the counter Q-CNTR is decremented or incremented are the same as those of the first embodiment, and reference should be made to FIGS. 7, 9, and 10.

Figure 22:
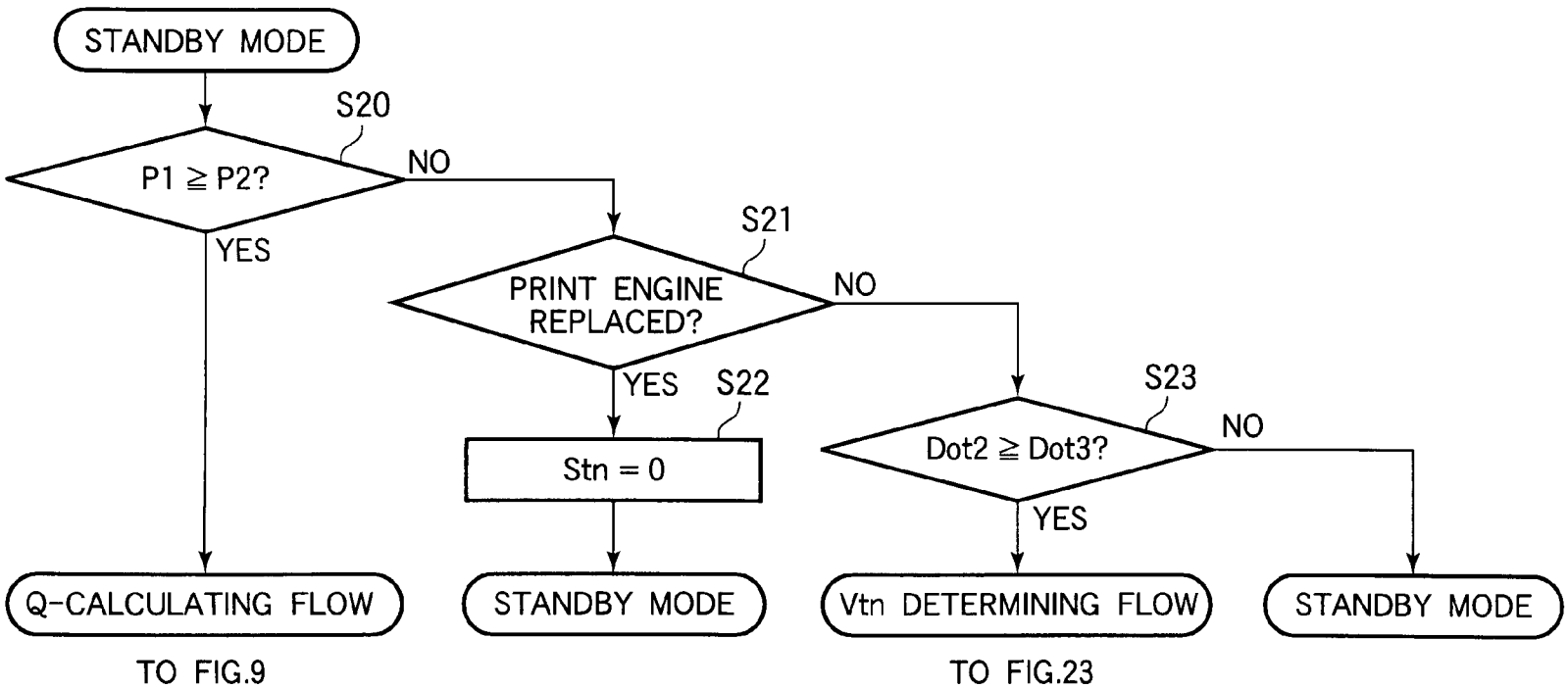
FIG. 22 is a flowchart illustrating the operation of the printer when the printer is in a standby mode.

FIG. 22 is a flowchart illustrating the operation of the printer 1 when the printer 1 is in a standby mode. At step S20, the transfer voltage correcting section 55 makes a decision to determine whether the time P1 counted by the timer 47 is P1≧P2. If YES at step S20, the program proceeds to a Q-calculating flow (FIG. 9) in which the counter Q-CNTR is incremented or decremented. If NO at step S20, the program proceeds to step S21. The predetermined time P2 is selected to be "30 minutes" in the second embodiment.

At step S21, the print engine replacement detecting section 57 makes a decision to determine whether any one of the print engines 101-104 has been replaced with a new, unused one. If YES at step S21, the program proceeds to step S22. If NO at step S21, the program proceeds to step S23.

At step S22, the transfer voltage correcting section 55 resets the toner status signal Stn indicative of deterioration of the toner since any one of the print engines 101-104 has been replaced. Then, the printer 1 enters the standby mode.

Figure 23:
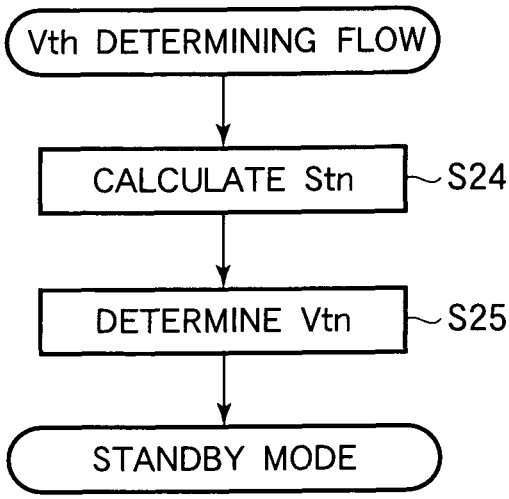
FIG. 23 is a flowchart illustrating a Vtn determining operation.

At step S23, the transfer voltage correcting section 55 makes a decision to determine whether the number of dots, Dot2, counted by the dot counter 49 is equal to or larger than a predetermined value, Dot3. If the answer is Dot2≧Dot3, the program proceeds to a Vtn determining flow (FIG. 23). If the answer is not Dot2≧Dot3, the program jumps back to the standby mode. In the second embodiment, the predetermined value Dot3 is selected to be "3,000,000" which corresponds to a remaining amount of toner equivalent to 5% of the total capacity of the toner cartridge.

FIG. 23 is a flowchart illustrating the Vtn determining flow. The Vtn determining flow will be described with reference to FIG. 23.

At step S24, using equation (4) below, the toner status calculating section 56 calculates the toner status signal Stn based on the predetermined value Dot3 and the cumulative number of rotations of the photoconductive drum, Drm3, (counted by the drum counter 48) since the Vtn determining flow was performed last time. Then, the toner status calculating section 56 stores the calculated toner status signal Stn into the memory 51-1. The toner status signal Stn is representative of a degree of deterioration of the toner.

$$Stn=(Stn+\mathrm{Dot}3/Drm3)/2 \tag{5}$$

At step S25, the transfer voltage correcting section 55 determines the value of Vtn based on the thus calculated Stn, and then stores the calculated Vtn into the memory 51-1.

FIG. 25 is the Vtn table 58 that lists the toner status signal Stn and the corresponding minimum correction value Vtn. The transfer voltage correcting section 55 refers the Vtn table 58 to determine a value of the Vtn using a corresponding calculated toner status signal Stn. For example, the value of the Vtn is "−400 V" for the toner status signal Stn less than 1000.

Figure 24:
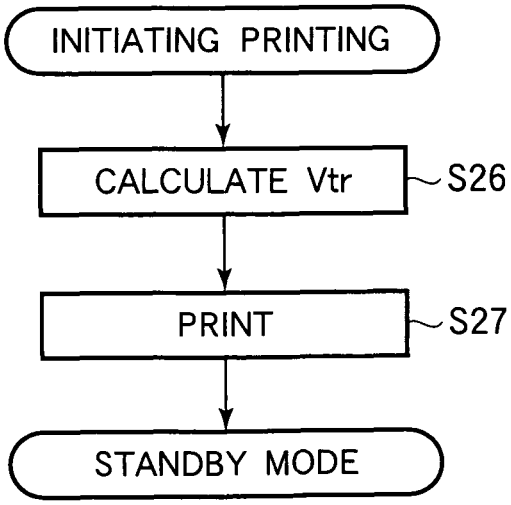
FIG. 24 is a flowchart illustrating the printing operation.
Figure 27:
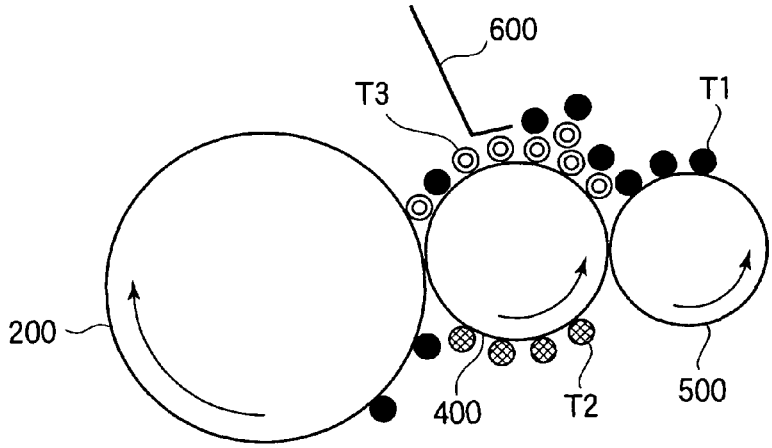
FIG. 27 illustrates the relation between the amount of toner remaining on the developing roller and the amount of charge acquired by the toner.
Figure 28:
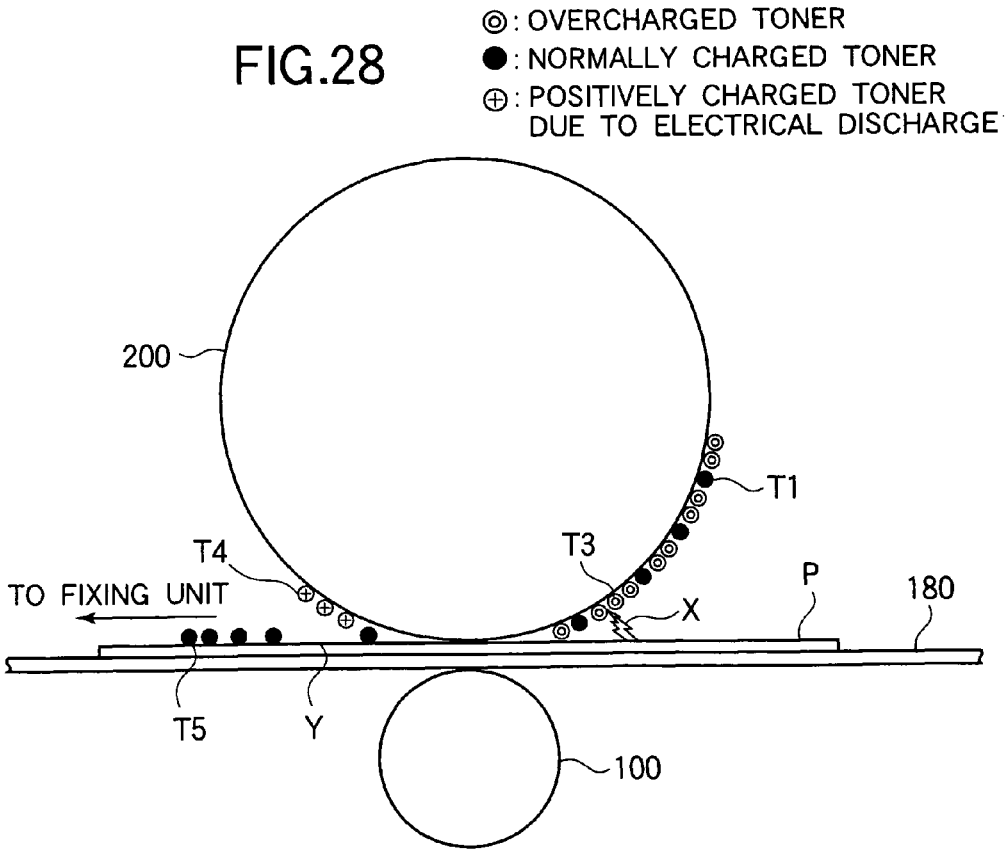
FIG. 28 illustrates the relation between the increase in the amount of charge on the toner and the occurrence of poor transfer performance.

FIG. 24 is a flowchart illustrating the printing operation. The printing operation will be described with reference to FIG. 24.

At step S26, the transfer voltage correcting section 55 calculates the Vtr using equation (6) and then stores the calculated Vtr into the memory 51-1.

$$Vtr=Vtr1+Vq\times Q+Vtn \tag{6}$$

where Vtr is the transfer voltage, Vtr1 is a basic transfer voltage, Vq is a minimum correction value based on the print duty D1, Q is the count of the counter Q-CNTR, and Vtn is the minimum correction value based on deterioration of toner.

At step S27, the high voltage controller 41 reads the value of transfer voltage Vtr from the memory 51-1 and then sends a command to the transferring voltage generator 45, commanding to output the transfer voltages Vtr to be supplied to the transfer rollers 1001-1004, so that the print engines perform printing normally. The high voltage controller 41 also commands the transferring voltage generator 45 to shut off the transfer voltage Vtr to be supplied to the transfer rollers 1001, 1002, 1003, and 1004.

As described above, the transfer voltage correcting section of the second embodiment controls the transfer voltage to decrease in accordance with the increase in the amount of charge on the toner, which may vary depending on the situation in which the printer 1 is used, thereby reducing the electric field strength across the photoconductive drum and the corresponding transfer roller so that there is less chance of electrical discharge taking place across the photoconductive drum and corresponding transfer roller. In this manner, the transfer voltage is corrected in accordance with the change in the optimum value of transfer voltage, thereby preventing poor transfer performance to provide good print quality at all times.

Although an LED head is used to form an electrostatic latent image on a photoconductive drum, a laser head, for example, may be used in place of the LED head. While the toner images are formed in the order of black, yellow, magenta, and cyan, the order in which the toner images are formed is not limited to this. The toner images may be formed in any order as long as the black, yellow, magenta, and cyan toner images are formed.

While the invention has been described with respect to an image forming apparatus that incorporates four print engines, the invention may also be applicable to an image forming apparatus incorporating any number of print engines.

What is claimed is:

1. An image forming apparatus in which a developer image is transferred by a transfer section from an image bearing body onto a recording medium, the image forming apparatus comprising:

a memory that stores correction values for a transfer voltage, the correction values corresponding to changes in an operation status of the image forming apparatus;

an apparatus usage information obtaining section that obtains information on the operation status that includes at least a number of rotations of the image bearing body per unit time and a period of time during which the transfer section is left idle; and a transfer voltage correcting section that corrects the transfer voltage based on the correction values and the information on the operation status that includes at least the number of rotations of the image bearing body per unit time and a period of time during which the transfer section is left idle, wherein if the number of rotations of the image bearing body per unit time is smaller than a reference value, said transfer voltage correcting section corrects the transfer voltage based on the correction values.

2. The image forming apparatus according to claim 1, wherein said apparatus usage information obtaining section comprises:

a number-of-printed-pages obtaining section that obtains information on a number of printed pages that are printed in a predetermined period of time;

a number-of-printed-dots obtaining section that obtains information on a number of printed dots that are printed in the predetermined period of time; and a print duty obtaining section that obtains information on a print duty based on the information obtained by said number-of-printed-pages obtaining section and the information obtained by said number-of-printed-dots obtaining section.

3. The image forming apparatus according to claim 1, wherein said apparatus usage information obtaining section includes a remaining developer detecting section that obtains information on a remaining amount of a developer material in a developer supplying portion.

4. The image forming apparatus according to claim 1, wherein said apparatus usage information obtaining section includes an operation time measuring section that obtains information on a period of time during which the image forming apparatus is left idle.

5. The image forming apparatus according to claim 1, wherein said apparatus usage information obtaining section includes an environment condition detecting section that obtains information on conditions of an environment in which the image forming apparatus operates.

6. The image forming apparatus according to claim 5, wherein the information on the conditions of the environment includes temperature and humidity.

7. The image forming apparatus according to claim 1, wherein said apparatus usage information obtaining section includes a developer status obtaining section that obtains information on deterioration of a developer material held in a developer supplying portion.

8. The image forming apparatus according to claim 7, further comprising a printing mechanism that includes the image bearing body, wherein the information on deterioration of the developer material is a value calculated by the developer status obtaining section, and indicates a degree of deterioration of the toner since replacement of the printing mechanism.

9. An image forming apparatus in which when a transfer voltage is applied to a transfer section, a developer image is transferred by the transfer section from an image bearing body onto a recording medium, the image forming apparatus comprising:

an apparatus usage information obtaining section that obtains information including idle time information corresponding to a period of time during which the transfer section is left idle, the apparatus usage information obtaining section including a number of printed pages obtaining section that obtains information on a number of printed pages that are printed in a predetermined period of time, and information on a number of rotations of the image bearing body per unit time, and a number of printed dots obtaining section that obtains information on a number of printed dots that are printed in a predetermined period of time; and a transfer voltage correcting section that corrects the transfer voltage using the idle time information and the information obtained by said number of printed pages obtaining section and said number of printed dots obtaining section, if the number of rotations of the image bearing body per unit time is smaller than a reference value.

10. The image forming apparatus according to claim 9, further comprising a remaining developer detecting section that obtains information on a remaining amount of developer, wherein said transfer voltage correcting section corrects the transfer voltage based on the information obtained by said remaining developer detecting section.

11. The image forming apparatus according to claim 9, further comprising an environment condition detecting section that obtains information on conditions of an environment in which the image forming apparatus operates, wherein said transfer voltage correcting section corrects the transfer voltage based on the information obtained by said environment condition detecting section.

12. The image forming apparatus according to claim 11, wherein the information on the conditions of the environment includes temperature and humidity.

13. The image forming apparatus according to claim 9, wherein further comprising a developer status obtaining section that obtains information on deterioration of the developer, wherein said transfer voltage correcting section corrects the transfer voltage based on the information obtained by said remaining developer detecting section.

14. A method of applying a transfer voltage to a transfer section that transfers a developer image from an image bearing body onto a recording medium, the method comprising:

generating a correction value based on which the transfer voltage is corrected in accordance with the operation status;

obtaining apparatus usage information that includes at least a period of time during which the transfer section is left idle;

detecting a number of rotations of the image bearing body per unit time; and correcting the transfer voltage based on the correction value and the apparatus usage information, wherein if the number of rotations of the image bearing body per unit time is smaller than a reference value, the transfer voltage is corrected based on the correction value.

15. The method according to claim 14, wherein the transfer voltage is corrected based on the correction value such that poor transfer performance is prevented.

16. The method according to claim 14, wherein said obtaining apparatus usage information comprising:

obtaining information on a number of printed pages that are printed in a predetermined period of time;

obtaining information on a number of printed dots that are printed in a predetermined period of time; and obtaining information on a print duty based on the information on the number of printed pages and the information on the number of printed dots.

17. The method according to claim 14, wherein said obtaining apparatus usage information comprising obtaining information on a remaining amount of a developer material in a developer supplying portion.

18. The method according to claim 14, wherein said obtaining apparatus usage information comprising obtaining information on conditions of an environment in which the image forming apparatus operates.

19. The method according to claim 18, wherein the conditions of the environment include temperature and humidity.

20. The method according to claim 14, wherein said obtaining apparatus usage information comprising obtaining information on deterioration of a developer material.

21. The image forming apparatus according to claim 5, wherein said transfer voltage correcting section corrects the transfer voltage based on the correction values and the conditions of the environment.

22. The image forming apparatus according to claim 21, wherein the conditions of the environment include temperature and humidity.

* * * * *